United States Patent [19]

Jacobs

[11] Patent Number: 4,819,463

[45] Date of Patent: Apr. 11, 1989

[54] STEREO CABINET LOCK

[76] Inventor: Russell G. Jacobs, 195 Sawmill Rd., Brick, N.J. 08724

[21] Appl. No.: 125,140

[22] Filed: Nov. 20, 1987

[51] Int. Cl.[4] ..... E05B 73/00

[52] U.S. Cl. ..... 70/14; 70/80

[58] Field of Search ..... 70/134, 80, 100, 101, 70/14, 360, DIG. 19–20, 451, 465; 292/289, 292, 295, 259 R, 92, DIG. 65, DIG. 71

[56] References Cited

U.S. PATENT DOCUMENTS

| | | | |
|---|---|---|---|
| 2,338,851 | 1/1944 | Heyer | 70/14 |
| 2,720,102 | 10/1955 | Spain | 70/14 |
| 3,423,968 | 1/1969 | Foote | 70/14 |

*Primary Examiner*—Robert L. Wolfe

*Attorney, Agent, or Firm*—Jerry T. Kearns

[57] ABSTRACT

A lock for a stereo cabinet of a type having an interior floor and two swinging glass doors meeting along a vertical line in a closed position has a toothed lock bar for mounting to the interior floor of the stereo cabinet. A toothed tip portion of the lock bar extends transversely to the swinging glass doors and intersects the vertical line. A lock cylinder block has a slot for engagement over the toothed tip portion of the lock bar. A keyed cylinder in the lock cylinder block has a pair of arcuate cam lugs which selectively move a pair of locking arms into and out of locking engagement with the toothed side edges of the lock bar tip. A pair of leaf springs bias the locking arms toward a central portion of the slot. The lock bar has a radiused end provided with a U shaped rubber bumper. One face of the lock cylinder block is provided with a rubber bumper to avoid scratching the glass doors. The lock bar is a thin flat strip which is mounted by a pair of screws to the interior floor of the stereo cabinet. A pair of rubber washers slightly space the lock bar above the floor.

16 Claims, 3 Drawing Sheets

STEREO CABINET LOCK

BACKGROUND OF THE INVENTION

1. Field of the Invention

The present invention relates to locking devices, and more particularly pertains to a locking device for a stereo cabinet of the type having two swinging glass doors meeting along a central vertical line in a closed position. The typical stereo cabinet is provided with two swinging glass doors which are secured in a closed position by a magnetic fastening element on each of the doors. While these magnetic latches serve to retain the doors in a closed position, they are insufficient to prevent unauthorized tampering with equipment within the stereo cabinet. A locking arrangement for providing a larger degree of security to these types of stereo cabinets is especially desired in households with children. Children are prone to tamper with, and sometimes damage expensive equipment within these stereo cabinets. In order to overcome these problems, the present invention provides a new and improved stereo cabinet lock which may be quickly retrofitted without modification to existing stereo cabinets and may be utilized with a slightly modified form of a new stereo cabinet.

2. Description of the Prior Art

Various types of locking devices are known in the prior art. A typical example of such a locking device is to be found in U.S. Pat. No. 773,319, which issued to A. Grossbeck on Oct. 25, 1904. This patent discloses a lock for use with trunks and chests which utilizes a spring biased locking bar for automatic engagement with a pair of latch recesses. U.S. Pat. No. 1,759,402, which issued to J. Hogan on May 20, 1930, discloses a lock for a chest which automatically engages upon closing of the lid of the chest. U.S. Pat. No. 1,845,458, which issued to H. Walton on Feb. 16, 1932, discloses a lock for sliding doors which utilizes a pivotal lock bar mounted on one of the sliding glass doors and a cooperating latch member mounted on the other of the sliding glass doors. U.S. Pat. No. 1,846,822, which issued to E. Vogt on Feb. 23, 1932, discloses a locking mechanism for use with a cabinet having sliding glass doors. This device utilizes a locking cylinder for moving a spring biased bolt into and out of locking engagement. U.S. Pat. No. 2,458,046, which issued to E. Audet on Jan. 4, 1949, discloses a key actuated lock for use with swinging doors. The device utilizes a keyed cylinder with spring biased locking pins. U.S. Pat. No. 3,412,586, which issued to B. Sterner on Nov. 26, 1968, discloses a safety lock for coldrooms. A lock may be unlocked from within the cold room even when the bolt has been placed in a locking position by a keyed cylinder mounted on the outside of the coldroom door. U.S. Pat. No. 4,262,503, which issued to J. Kuebler on Apr. 21, 1981, discloses a locking device for swinging doors. The locking device has a pair of spaced tubes which are designed to be received on opposite sides beneath a door to abut the door frame, thus preventing the door from being swung open.

While the above mentioned devices are suited for their intended usage, none of these devices provide a locking device suitable for use with a stereo cabinet having two swinging glass doors meeting along a central vertical line in a closed position. Further, none of the aforesaid devices provide a lock which may be easily retrofitted without modification to existing stereo cabinets. An additional feature of the present invention not contemplated by the previously described prior art locking devices is the use of a toothed lock bar mounted on the interior floor of a stereo cabinet for cooperation with a locking cylinder block engaged over a tip portion of the lock bar extending beneath the swinging glass doors of the stereo cabinet. Inasmuch as the art is relatively crowded with respect to these various types of locking devices, it can be appreciated that there is a continuing need for and interest in improvements to such locking devices, and in this respect, the present invention addresses this need and interest.

SUMMARY OF THE INVENTION

In view of the foregoing disadvantages inherent in the known types of locking devices now present in the prior art, the present invention provides an improved stereo cabinet lock. As such, the general purpose of the present invention, which will be described subsequently in greater detail, is to provide a new and improved stereo cabinet lock which has all the advantages of the prior art locking devices and none of the disadvantages.

To attain this, a representative embodiment of the concepts of the present invention is illustrated in the drawings and makes use of a thin flat locking bar having a tip portion with a radiused end and toothed side edges. A pair of apertures on an opposite end of the locking bar receive screws for mounting the locking bar on the interior floor of a stereo cabinet. A pair of rubber washers are utilized to space the locking bar slightly above the stereo cabinet floor. The locking bar extends transversely, slightly beneath the two swinging glass doors of the stereo cabinet. The locking bar tip intersects the central vertical line where the side edges of the two swinging glass doors meet when in a closed position. The locking bar may also extend through juxtaposed notches provided in the swinging glass doors. The radiused end of the locking bar tip portion is provided with a U shaped bumper. A locking cylinder block has a slot for receipt over the toothed tip portion of the lock bar. A keyed cylinder is provided with a locking mechanism for selectively locking the lock cylinder block into and out of engagement with the toothed side edges of the lock bar tip portion. A face of the lock cylinder block may be provided with a rubber bumper to avoid scratching the swinging glass doors.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stereo cabinet lock which has all the advantages of the prior art locking devices and none of the disadvantages.

It is another object of the present invention to provide a new and improved stereo cabinet lock which may be easily and efficiently manufactured and marketed.

It is a further object of the present invention to provide a new and improved stereo cabinet lock which is of a durable and reliable construction.

An even further object of the present invention is to provide a new and improved stereo cabinet lock which is susceptible of a low cost of manufacture with regard to both materials and labor, and which accordingly is then susceptible of low prices of sale to the consuming public, thereby making such stereo cabinet locks economically available to the buying public.

Still yet another object of the present invention is to provide a new and improved stereo cabinet lock which provides in the apparatuses and methods of the prior art some of the advantages thereof, while simultaneously overcoming some of the disadvantages normally associated therewith.

Still another object of the present invention is to provide a new and improved stereo cabinet lock which may be easily retrofitted without modification to an existing stereo cabinet.

Yet another object of the present invention is to provide a new and improved stereo cabinet lock which utilizes a toothed locking bar mounted to an interior floor of the stereo cabinet and a lock cylinder block provided with a slot for engagement over the lock bar.

Even still another object of the present invention is to provide a new and improved stereo cabinet lock which may be easily retrofitted to existing stereo cabinets and provides greater security to the contents of the stereo cabinet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
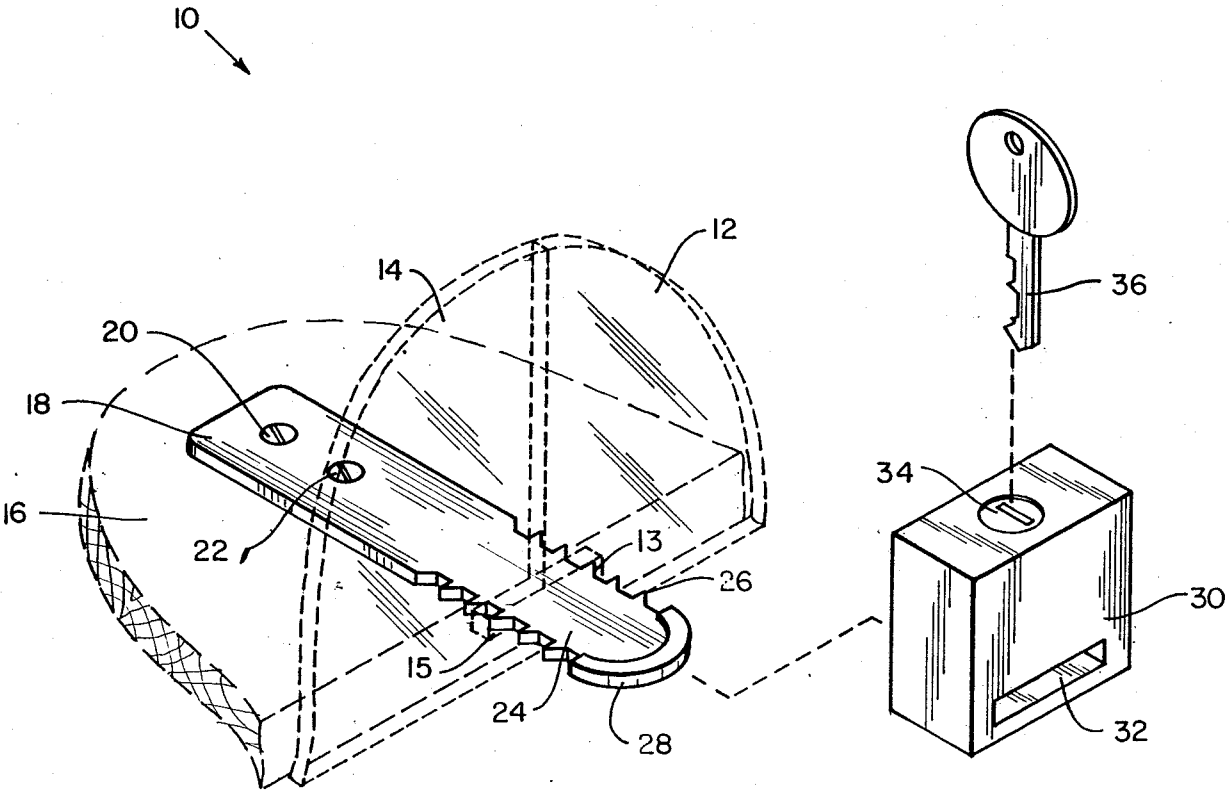
FIG. 1 is a perspective view of a portion of a stereo cabinet utilizing the stereo cabinet lock of the present invention.

With reference now to the drawings, and in particular to FIG. 1 thereof, a new and improved stereo cabinet lock embodying the principles and concepts of the present invention and generally designated by the reference numeral 10 will be described.

More specifically, it will be noted that the first embodiment 10 of the invention includes a stereo cabinet having a pair of swinging glass doors 12 and 14 which meet in a closed position along a central vertical line. The stereo cabinet has an interior floor 16 on which a thin flat lock bar 18 is mounted by a pair of screws 20 and 22. A tip portion 24 of the locking bar 18 has side edges provided with a plurality of teeth 26. The tip portion 24 has a radiused end over which a U shaped rubber bumper 28 is mounted. A lock cylinder block 30 has a keyed cylinder 34 operated by a key 36. A slot 32 extends transversely to the keyed cylinder 34 for receipt over the tip portion 24 of the lock bar 18. An internal locking mechanism of a lock cylinder block 30, to be subsequently described, allows selective locking engagement of the lock cylinder block 30 over the tip portion 24 of the locking bar 18. In this fashion, the swinging doors 12 and 14 may be locked in a closed position by virtue of their abutment with the rear face of the lock cylinder block 30. It should be pointed out that, in stereo cabinets in which the lower ends of swinging glass doors 12 and 14 extend slightly above the interior stereo cabinet floor 16, the locking bar tip portion 24 will extend beneath the lower edges of the swinging doors 12 and 14. In stereo cabinets in which the swinging doors 12 and 14 extend beneath the interior floor 16, juxtaposed notches 13 and 15 may be provided in the doors 12 and 14. Alternatively, the locking bar 18 could be mounted to the lower exterior surface of the floor 16. It is to be realized that the mounting bar 18 can also be mounted to a top interior wall of the stereo cabinet, depending upon the configuration of the particular cabinet.

Figure 2:
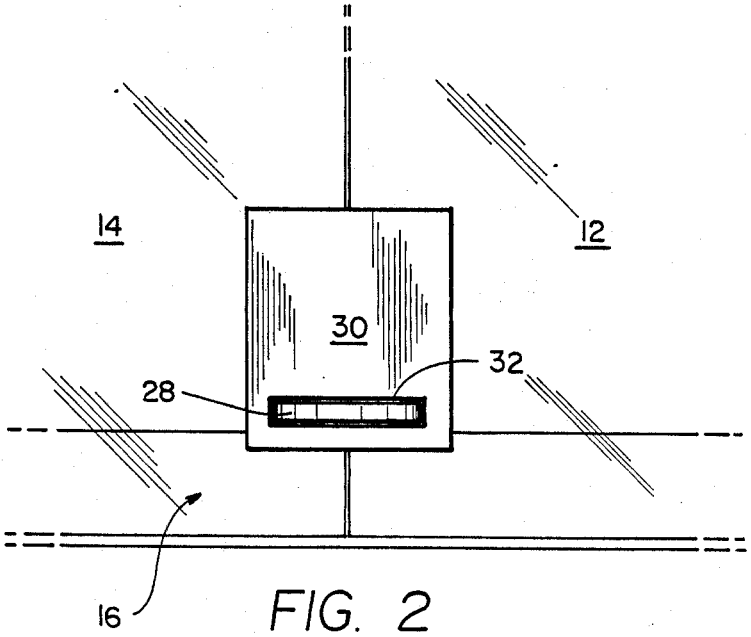
FIG. 2 is a partial front view of a stereo cabinet utilizing the stereo cabinet lock of the present invention.

With reference now to FIG. 2, it may be seen that the locking cylinder block 30 is received over the U shaped rubber bumper 28 on the radiused end of the tip portion 24 of the lock bar 18. The rear face of the lock cylinder block 30 abuts each of the glass doors 12 and 14, thus securing them in a closed position.

Figure 3:
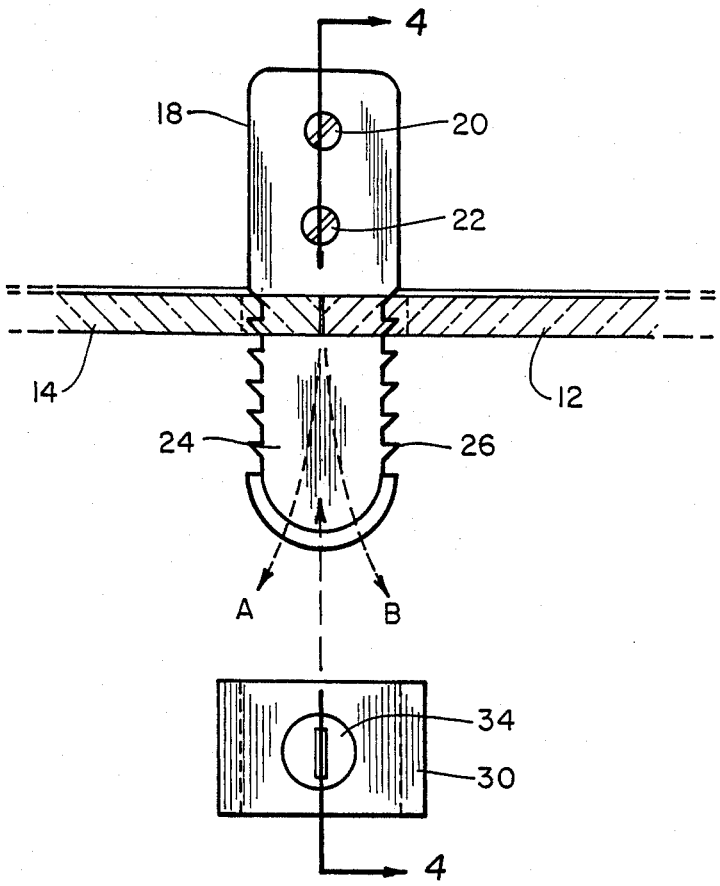
FIG. 3 is a top view of the stereo cabinet lock of the present invention.

With reference now to FIG. 3, it may be understood that the swinging doors 12 and 14 meet along a central line in a closed position. Swinging door 12 may be swung along an arc B to an open position. Swinging door 14 may be also swung along an arc A to an open position. The tip portion 24 of the lock bar 18 extends transversely to the swinging doors 12 and 14 and intersects their central vertical meeting line.

Figure 4:
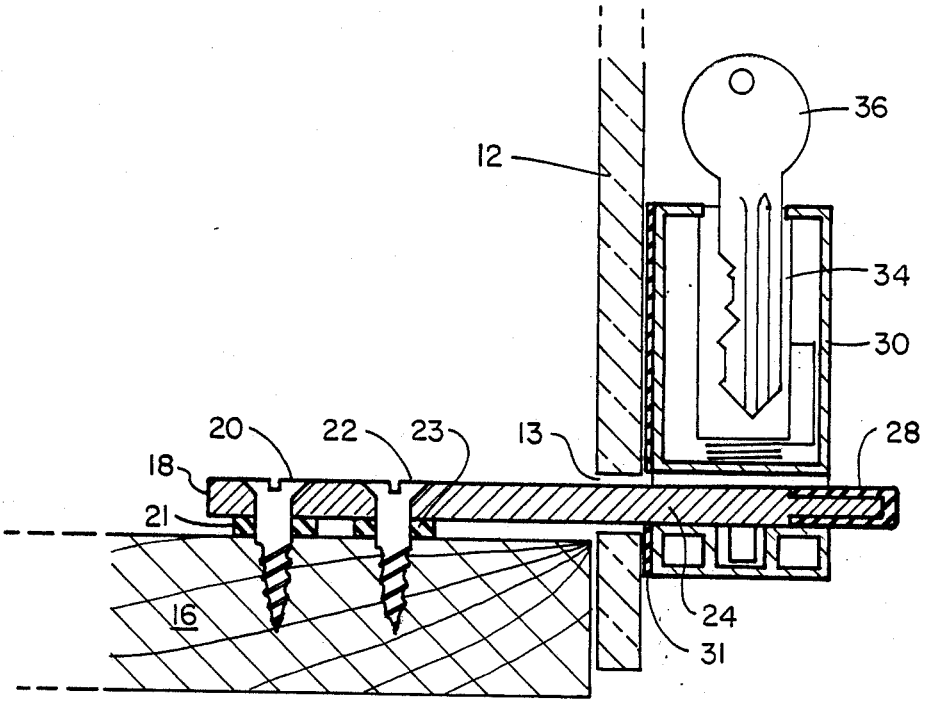
FIG. 4 is a side cross sectional view taken along line 4—4 of FIG. 3 illustrating the stereo cabinet lock of the present invention mounted on a stereo cabinet.

In FIG. 4, a side cross sectional view of the stereo cabinet lock of the present invention is provided. A pair of rubber spacing washers 21 and 23 are provided around each of the mounting screws 20 and 22. These washers serve to slightly space the lock bar 18 above the interior floor 16 of the stereo cabinet. The locking cylinder block 30 is provided with a rubber bumper 31 to prevent scratching of the glass doors 12 and 14.

Figure 5:
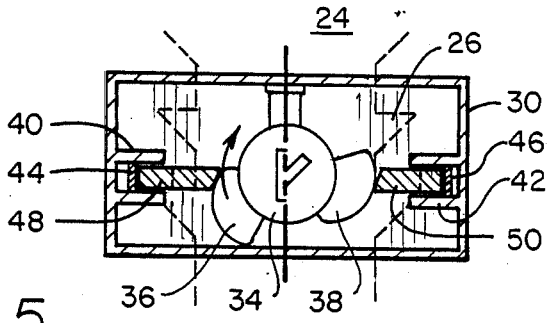
FIG. 5 is a cross sectional view illustrating the locking mechanism of the lock cylinder block of the present invention. The left half of FIG. 5 illustrates the lock cylinder block in a locked position and the right half of FIG. 5 illustrates the locking cylinder block in an unlocked position.

In FIG. 5, a transverse cross sectional view is provided which illustrates the interior locking mechanism of the lock cylinder block 30. A pair of channels 40 and 42 extend longitudinally on opposite sides of the lock cylinder block 30. A leaf spring 44 and 46 is provided in each of the channels 40 and 42. The leaf springs urge a pair of locking arms 48 and 50 radially inwardly to a locking position. In the left half of FIG. 5, an arcuate cam lug 36 on the keyed cylinder 34 is moved out of engagement with the locking arm 48, allowing it to move radially inwardly under the bias of spring 44 into locking engagement with the teeth 26 of the locking bar tip portion 24. In the right half of FIG. 5, the lock cylinder 34 is illustrated in an unlocked position. In this position, the arcuate cam lug 38 is moved into engagement with the locking arm 50, moving the locking arm radially outwardly against the bias of spring 46, out of engagement with the teeth 26 of the lock bar tip portion 24.

Figure 6:
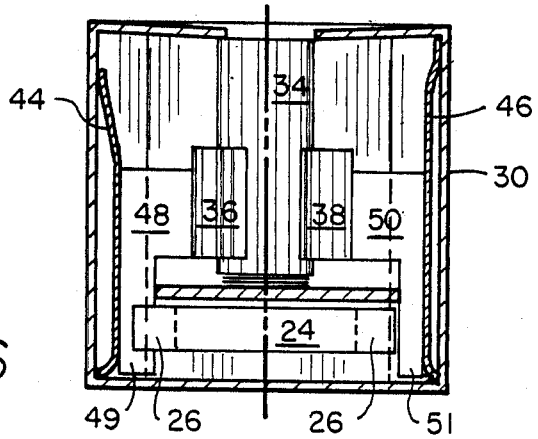
FIG. 6 is a longitudinal cross section of the lock cylinder block of the present invention. The left half of FIG. 6 illustrates the lock cylinder block in a locked position and the right half of the FIG. 6 illustrates the lock cylinder block in an unlocked position.

In FIG. 6, a longitudinal cross section of the internal locking mechanism of the lock cylinder block 30 is provided. In the left half of FIG. 6, the arcuate cam lug 36 on the keyed cylinder 34 is moved out of engagement with the locking arm 48, allowing the locking arm 48 to be moved radially inwardly by the leaf spring 44. An end portion 49 of the locking arm 48 is moved radially inwardly into engagement with the teeth 26 on the locking bar tip portion 24. In the right half of FIG. 6, the arcuate cam lug 38 is moved into engagement with the locking arm 50, moving the locking arm 50 radially outwardly against the bias of the leaf spring 46. The end portion 51 of the locking arm 50 is thus moved radially outwardly from engagement with the teeth 26 of the locking bar tip portion 24.

With reference now to FIG. 1, it will now be understood that the rearward inclination of the teeth 26 allows the slotted portion 32 of the locking cylinder block 30 to be slipped over the tip portion 24 of the locking bar 18. The locking cylinder block 30 will be advanced along the mounting tip portion 24 until the rubber bumper 31 (FIG. 4) is moved into abutment with the swinging doors 12 and 14.

With reference now to FIG. 6, it will be understood that leaf springs 44 and 46 will move the locking arms 48 and 50 into engagement with the teeth 26 of the locking bar tip 24. The inclination of the teeth 26 prevents the locking cylinder block 30 from being withdrawn from the tip portion 24. By manipulation of the key 36 in the cylinder 34, the cam lugs 36 and 38 may be caused to move the locking arms 48 and 50 radially outwardly into engagement with the locking arm 48 and 50, thus allowing the locking cylinder block 30 to be withdrawn from the tip portion 24 of the locking bar 18. This, then allows the doors 12 and 14 to be opened.

The locking bar 18 and locking cylinder block 30 and related components may be inexpensively formed from stamped sheet metal. Various plastic materials may also be utilized, as desired. The stereo cabinet lock of the present invention may be easily retrofitted to existing stereo cabinets, or may be provided with newly manufactured stereo cabinets. It will now be recognized that the present invention provides an inexpensive stereo cabinet lock which furnishes an enhanced degree of security.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved stereo cabinet lock for use with a stereo cabinet having an interior floor and two swinging doors meeting along a vertical line in a closed position, comprising:
   - a thin flat lock bar;
   - said lock bar having a tip portion having toothed side edges and a radiused end;
   - a rubber U shaped bumper on said radiused end;
   - said lock bar having a mounting portion having a pair of spaced apertures;
   - a threaded fastener extending through each of said apertures for mounting said lock bar on said interior floor of said stereo cabinet with said tip portion extending exteriorly of said cabinet transversely to said swinging doors and intersecting said vertical line;
   - a rubber spacing washer around each of said threaded fasteners;
   - a lock cylinder block for selective locking engagement over said lock bar tip portion;
   - a slot in said lock cylinder block;
   - a keyed cylinder extending transversely to said slot;
   - a pair of arcuate cam lugs on opposite sides of said keyed cylinder;
   - a pair of lock arms adjacent each of said cam lugs on opposite sides of said slot;
   - and
   - a pair of leaf springs, one of said springs biasing each of said lock arms towards a central portion of said slot.

2. A new and improved stereo cabinet lock for a stereo cabinet having an interior floor and two swinging doors meeting along a central vertical line in a closed position, comprising:

lock bar means;

said lock bar having a tip portion with toothed edges;

means for mounting said lock bar means on the interior floor of said stereo cabinet with said tip portion intersecting said vertical line and extending exteriorly of said cabinet beneath said swinging doors;

spacing washer means for spacing said lock bar means sightly above said interior floor;

lock cylinder block means for selective engagement over said lock bar tip portion;

and said lock cylinder block means having means for selective locking and unlocking engagement of said lock cylinder block means with said tooth edges of said lock bar tip portion.

3. The stereo cabinet lock of claim 2, further comprising a pair of spaced apertures in said lock bar;

a screw extending through each of said apertures for engagement with said interior floor;

and one of said spacing washers surrounding each of said screws.

4. The stereo cabinet lock of claim 2, further comprising a U shaped bumper means on an end of said lock bar tip portion.

5. The stereo cabinet lock of claim 2, further comprising bumper means on a rear face of said lock cylinder block means.

6. The stereo cabinet lock of claim 2, wherein said lock cylinder block means further comprises a slot.

7. The stereo cabinet lock of claim 6, wherein said lock cylinder block means further comprises a keyed cylinder having a pair of arcuate cam lugs.

8. The stereo cabinet lock of claim 7, wherein said lock cylinder block means further comprises a pair of locking arms disposed on opposite sides of said slot and mounted for radial movement by said cam lugs.

9. The stereo cabinet lock of claim 8, wherein said lock cylinder block means further comprises a pair of leaf springs for biasing each of said locking arms to a center portion of said slot.

10. In a stereo cabinet having an interior floor, a pair of swinging glass doors meeting along a vertical line in a closed position, the improvement comprising a stereo cabinet lock, said lock comprising:

a lock bar;

said lock bar having a tip portion with toothed side edges;

means for mounting said lock bar means on the interior floor of said stereo cabinet with said tip portion intersecting said vertical line and extending exteriorly of said cabinet past said doors;

juxtaposed notches formed in each of said swinging glass doors;

said lock bar tip portion extending through said notches;

lock cylinder block means for selective engagement over said lock bar tip portion;

and said lock cylinder block means having means for selective locking and unlocking engagement of said lock cylinder block means with said toothed side edges of said lock bar tip portion.

11. The stereo cabinet lock of claim 10, further comprising bumper means on a rear face of said lock cylinder block means.

12. The stereo cabinet lock of claim 10, further comprising a U shaped bumper means on an end of said lock bar tip portion.

13. The stereo cabinet lock of claim 10, wherein said lock cylinder block means further comprises a slot.

14. The stereo cabinet lock of claim 13, wherein said lock cylinder block means further comprises a keyed cylinder having a pair of arcuate cam lugs.

15. The stereo cabinet lock of claim 14, wherein said lock cylinder block means further comprises a pair of locking arms disposed on opposite sides of said slot and mounted for radial movement by said cam lugs.

16. The stereo cabinet lock of claim 15, wherein said lock cylinder block means further comprises a pair of leaf springs for biasing each of said locking arms to a center portion of said slot.

* * * * *